US005641243A

United States Patent [19]

Hsu

[11] Patent Number: 5,641,243

[45] Date of Patent: Jun. 24, 1997

[54] PILE ASSEMBLY AND METHOD OF ASSEMBLING THE SAME

[76] Inventor: Yu-Lien Hsu, No. 205, Chung-Chuang Lane, Len-Li Tsune, Tien-Wei Hsiang, Changhua Hsien, Taiwan

[21] Appl. No.: 392,267

[22] Filed: Feb. 22, 1995

[51] Int. Cl.[6] ..... E02D 17/20

[52] U.S. Cl. ..... 405/15; 405/258

[58] Field of Search ..... 405/15, 16, 17, 405/258, 259.1, 19, 21, 272, 274

[56] References Cited

U.S. PATENT DOCUMENTS

| | | | |
|---|---|---|---|
| 4,655,637 | 4/1987 | Vignocchi | 405/15 X |
| 5,429,450 | 7/1995 | Meidinger | 405/15 |

FOREIGN PATENT DOCUMENTS

| | | | |
|---|---|---|---|
| 610692 | 3/1935 | Germany | 405/21 |
| 205624 | 12/1982 | Japan | 405/15 |

*Primary Examiner*—James A. Lisehora

*Attorney, Agent, or Firm*—Michael D. Bednarek; Kilpatrick Stockton LLP

[57] ABSTRACT

A pile assembly includes a plurality of rows of ground-standing piles disposed on the original inclined plane along a slope and at least one connecting bar for connecting the ground-standing piles disposed on the same row. U-shaped suspension piles or L-shaped suspension piles having a hooked end can be disposed on planned locations of the inclined plane and are interlocked by interlocking bars.

6 Claims, 10 Drawing Sheets

PILE ASSEMBLY AND METHOD OF ASSEMBLING THE SAME

FIELD OF THE INVENTION

The present invention relates to means for holding soil dressing on slopes, and in particular to a pile assembly used in holding soil dressing on slopes and method of assembling the same.

BACKGROUND OF THE INVENTION

Piles used for fixing soil holding means, for example, a soil holding fence, can be classified into ground-standing piles and suspension piles. A ground-standing pile includes a pile body which is used as a fixing means for a soil holding means and a pile foot which is driven into soil. A suspension pile includes only a pile body which is suspended onto slopes and is linked to other suspension piles by using interlocking bars when are to be used. The interlocking bars can also provide the interlocks between each suspension piles disposed in different sections of a step-shaped slope so as to improve the total strength of the suspension piles.

Soil dressing vegetation is an important technique in the soil conservation technique. When the natural environment is not suitable for the growth of plants, soil dressing is provided on slopes to improve the natural environment. However, the soil dressing that is provided on a slope is easily washed away when it rains. Whether the soil dressing is easily washed away depends on whether the soil holding means can be firmly fixed on the slope or not.

Among conventional soil holding means, except for some concrete made holding means which are fixed on slopes by using a specific fixing method, other soil holding means are fixed on slopes by using a plurality of independent piles, ground-standing piles or suspension piles which are driven into the slope or firmly secured on the slope by interlocking bars respectively.

Conventional soil holding means are described in more detail as follows.

Referring to FIG. 1, there is shown a contour-type soil holding fence used for holding soil dressing., in which soil holding fences 1002 which are mounted with water permeable nets 1001 are supported by a plurality of independent ground-standing piles 1003 and are disposed on slope 1004 having an original inclined plane 1000. Note that soil dressing is usually paved on the original inclined plane 1000 to a thickness that is in alignment with the soil dressing inclined plane as indicated by broken line 1000-1. As the component gravity force of the soil dressing along the direction of the soil dressing inclined plane 1000-1 will be exerted on each independent ground-standing piles 1003 via soil holding fences 1002, if independent piles are driven into the slope 1004 to a sufficient depth and the soil paved on the original inclined plane 1000 is hard enough, independent ground-standing piles 1003 can remain uninclined and the soil dressing can be held between two soil holding fences 1002. However, in the case ground-standing independent piles 1003 are not driven into the slope 1004 to a sufficient depth and/or the soil dressing held between two soil holding fences 1002 is not hard enough, each of the independent ground-standing piles 1003 has a tendency to incline and thus the soil dressing paved on the slope 1004 are easily washed away when it rains.

Referring to FIG. 2, there is shown another conventional soil holding means which consists of a plurality of interlinked square soil holding net units in which at the corner of each square net unit, which is located at the upper portion of each square net unit, is driven into an independent ground-standing pile 2003 respectively. As the component gravity force of the soil dressing along the slope is also exerted on each independent ground-standing pile 2003, the same problem arises.

Referring to FIG. 3, there is shown a further conventional soil holding means which is a honeycomb-type soil holding means. A plurality of hexangular net units 3001 are supported by independent ground-standing piles 3003 which can be provided at the inside of any corners of each hexangular net unit 3001. Although the washing away of soil dressing can be effectively prevented by this means, this holding means necessitates a large number of independent ground-standing piles 3003 and thus the cost of constructing this means is high.

Aside from the above problems, when the slope to be paved with soil dressing is steep, hard, full of deep ditches and large, it is more difficult to set up the above conventional soil holding means, and thus usually after the setting up of the soil holding means, it is necessary to do some reinforcing and adjusting operations.

SUMMARY OF THE INVENTION

It is therefore an object of the invention to provide a soil holding means to overcome the above problems.

In this invention, a pile assembly is used to fix the soil holding means. The pile assembly includes a plurality of rows of ground-standing piles disposed on the original inclined plane along the slope, and at least one connecting bar for connecting ground-standing piles disposed on the same row. The pile assembly can further include a plurality of suspension piles disposed on planned locations of the original inclined plane, and at least one connecting bar for connecting at least one pair of the suspension piles.

According to an aspect of the invention, the suspension piles can be L-shaped suspension piles disposed on planned locations of the original inclined plane, each of the L-shaped suspension piles has a hook end for connecting to one of the ground-standing piles or other L-shaped suspension piles.

According to another aspect of the invention, the pile assembly can further include a plurality of interlocking bars for linking and interlocking the ground standing piles and the suspension piles in a direction transverse to the row on the original inclined plane.

BRIEF DESCRIPTION OF THE DRAWINGS

The present invention can be more fully understood by referring to the following detailed description and accompanying drawings, in which.

DETAILED DESCRIPTION OF THE INVENTION

Figure 1:
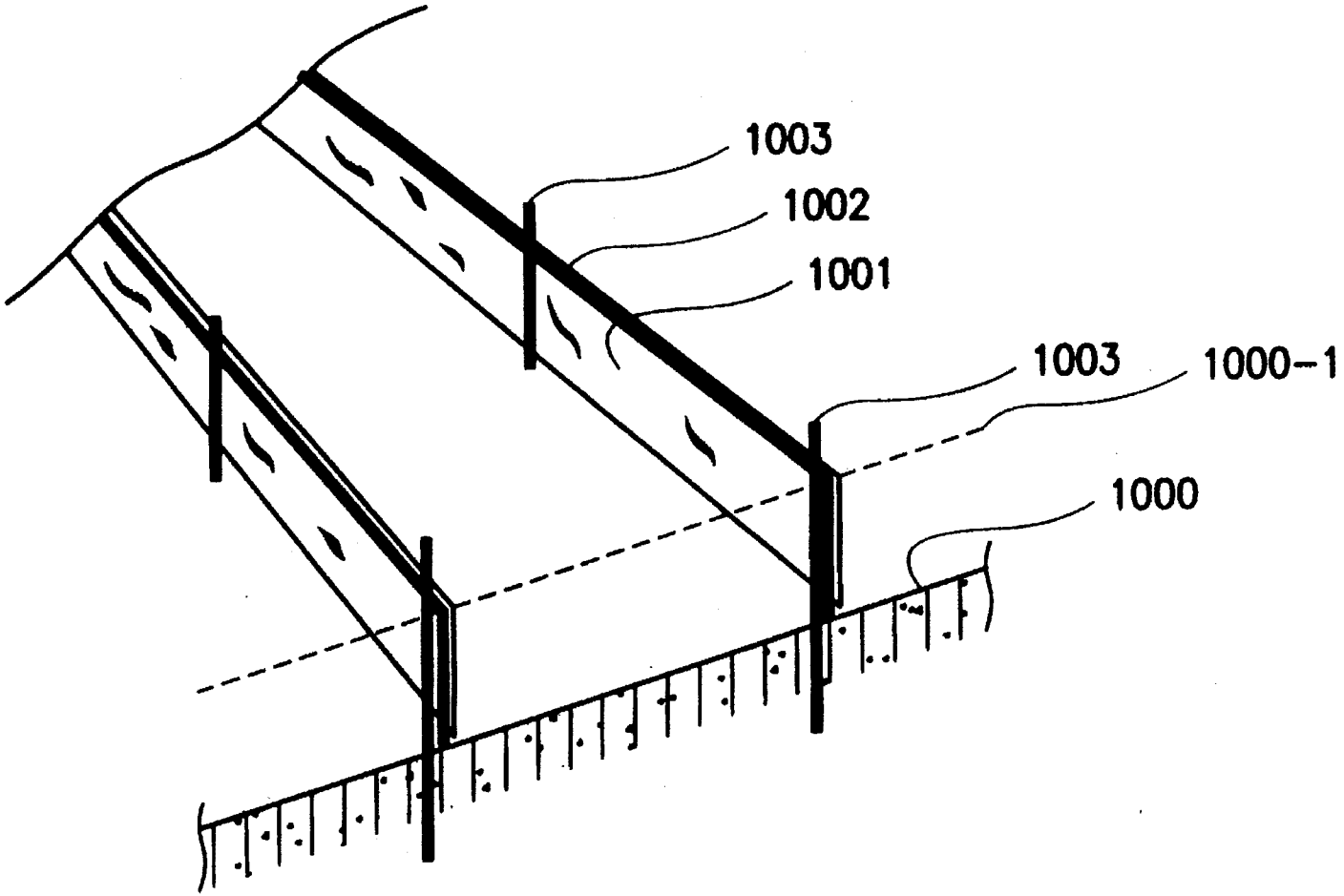
FIG. 1 (PRIOR ART)
FIG. 1 is a schematic diagram showing a conventional contour-type soil holding fence used for holding soil dressing.
Figure 2:
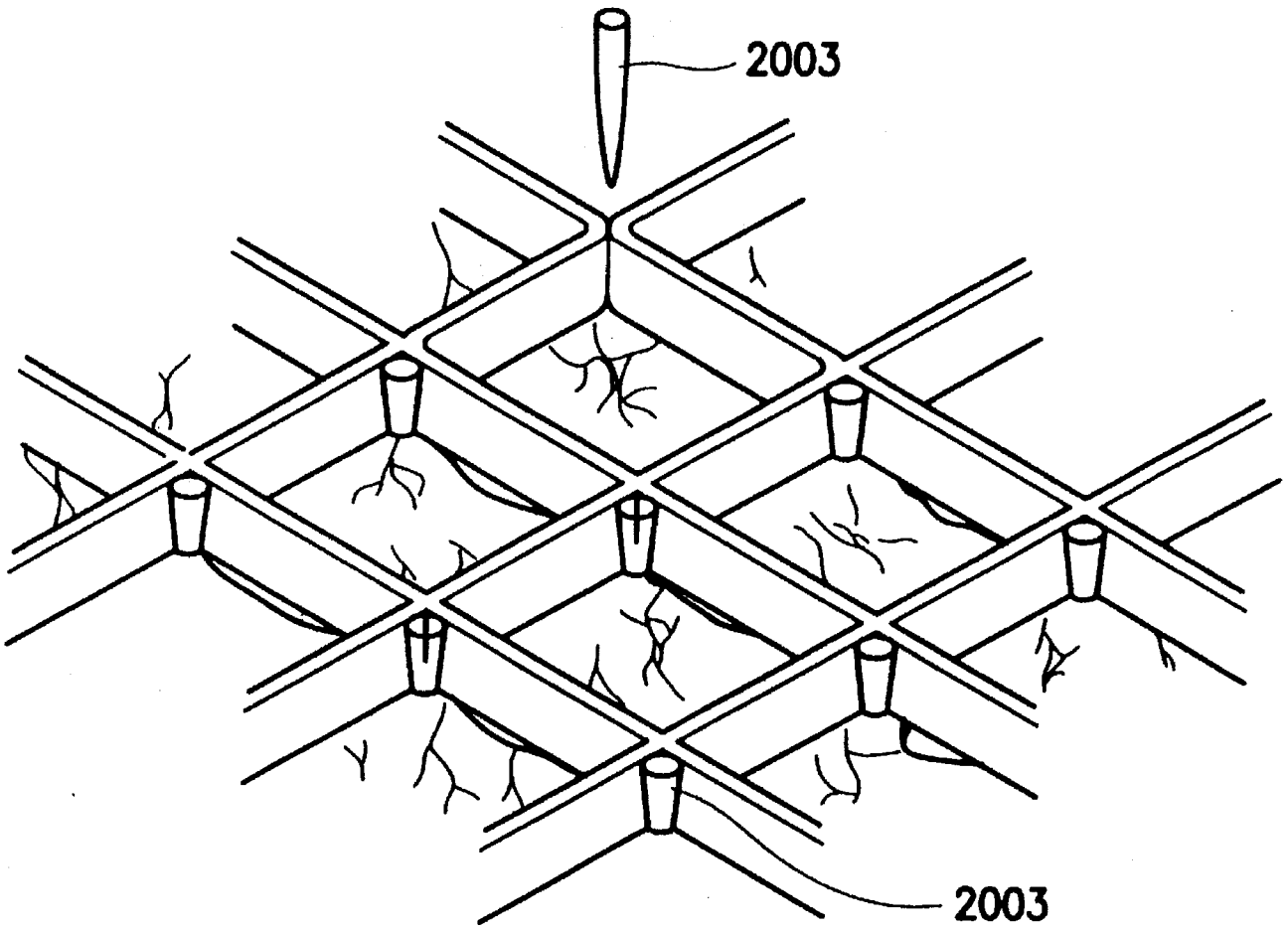
FIG. 2 (PRIOR ART)
FIG. 2 is a schematic diagram showing another conventional soil holding means which consists of a plurality of interlinked square soil holding net units.
Figure 3:
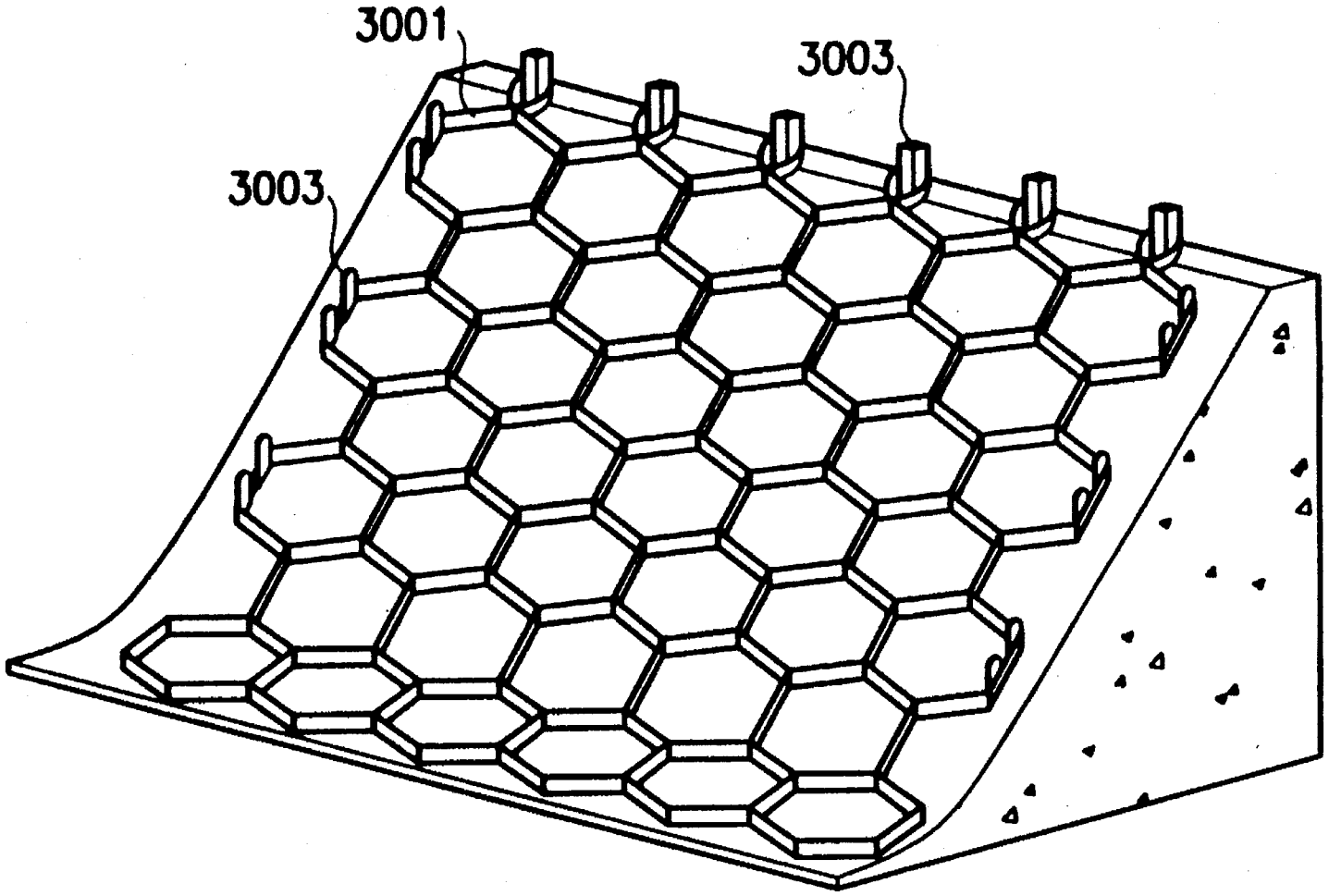
FIG. 3 (PRIOR ART)
FIG. 3 is a schematic diagram showing a further conventional soil holding means which is a honeycomb-type soil holding means.
Figure 4:
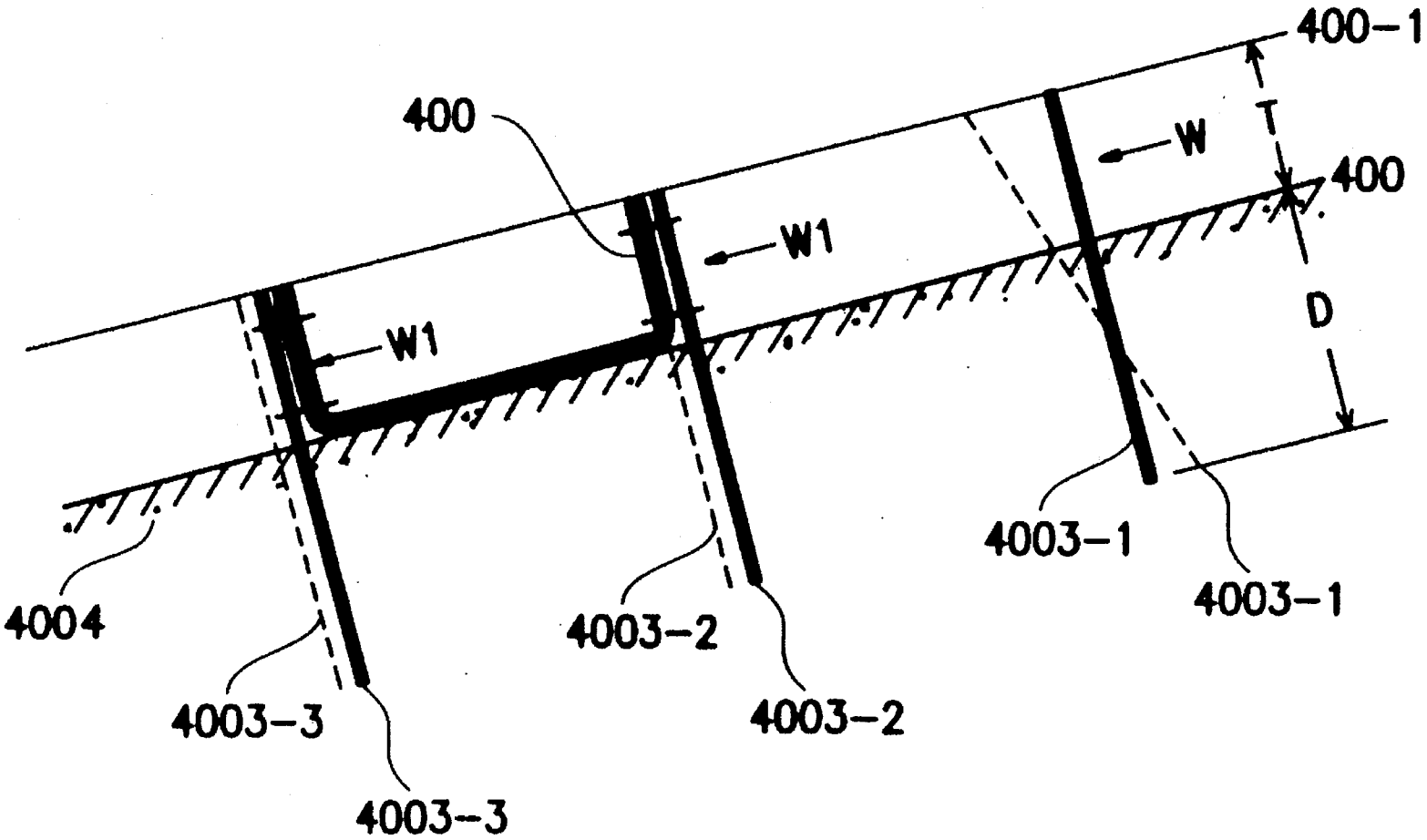
FIG. 4 is a schematic diagram used to explain the principle of the invention.

Referring to FIG. 4, there is shown a schematic diagram used to explain the principle of the invention. Three lines of ground-standing independent piles 4003-1, 4003-2, 4003-3 (only three piles are shown) are driven in a slope 4004 having an original inclined plane 4000 at the same depth so that their tops form the soil dressing inclined plane 4000-1. U-shaped rigid connecting bars 400 are disposed between independent piles 4003-2 and 4003-3 and connected with them at their top ends and bottom ends firmly. Note that the depth to which the independent pile is driven usually should be at least two times the thickness of the soil dressing layer, i.e., D>2 T. When the component gravity forces of the soil dressing, exerted on independent piles 4003-1, 4003-2 and 4003-3 are respectively represented by W, Wl and Wl, according to calculation, Wl will be three times W, i.e. Wl=3 W. That is, the force independent piles 4003-2 and 4003-3 can endure is three times that of independent pile 4003-1. As a result, after soil dressing is paved on the original inclined plane, independent pile 4003-1 will be slightly inclined as indicated by broken line 4003'-1 while independent pile 4003-2 and 4003-3 will not be inclined but be slided downardly due to the connecting of U-shaped connecting bars 400. Therefore, when one of said three independent piles has poor ground standing conditions, for example the soil under the pile is not hard enough, the other piles having better ground standing conditions will be subjected to greater pulling force so as to attain a mutually reinforcing effect. Also, when the number of the independent piles is increased, due to the interlocking effect, the operation and setting up of the independent piles can be facilitated.

DESCRIPTION OF PREFERRED EMBODIMENTS

Figure 5:
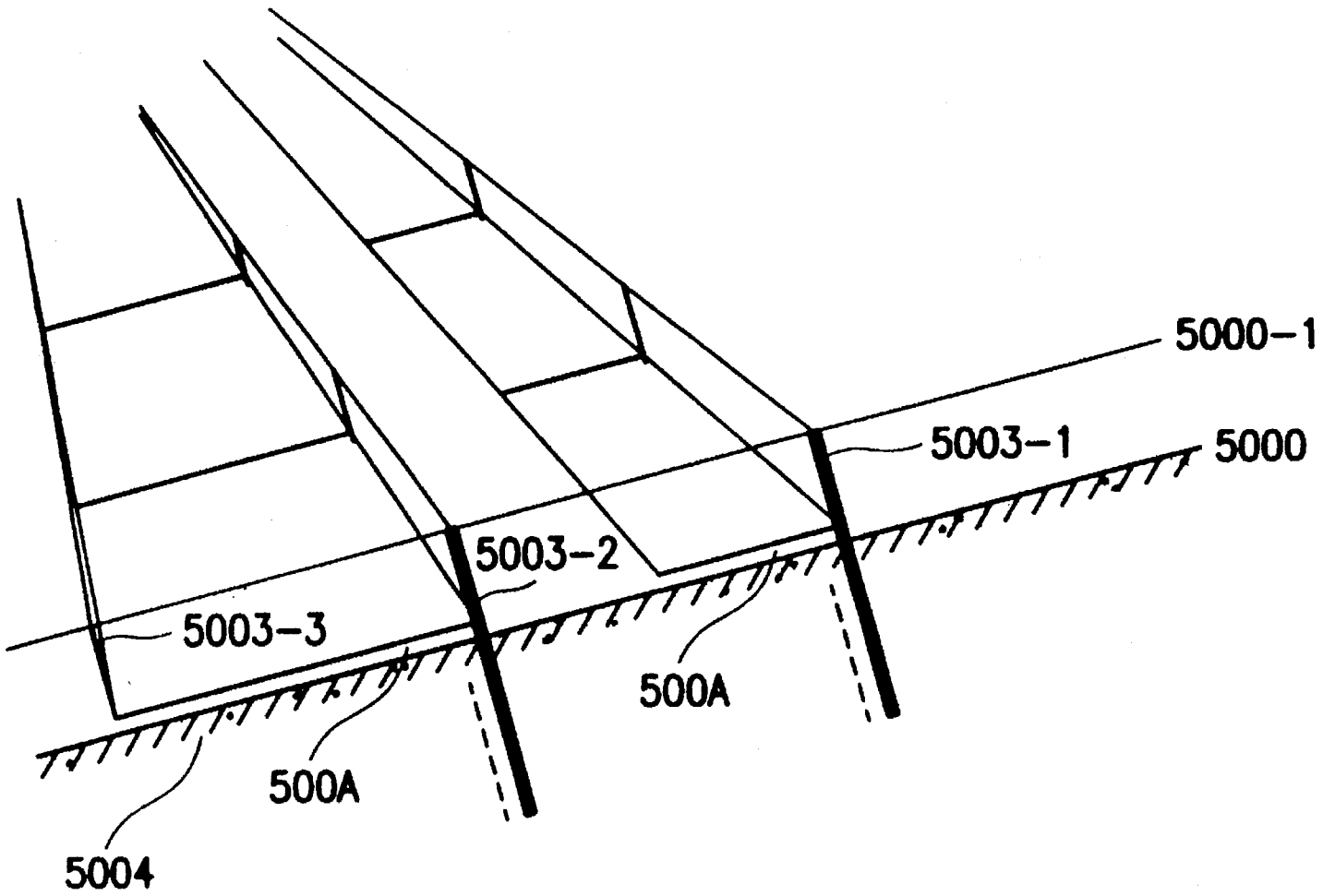
FIG. 5 is a schematic diagram showing a first embodiment of the present invention, in which three lines of ground-standing independent piles 5003-1, 5003-2 and 5003-3 are used.

Referring to FIG. 5, there is shown a first embodiment of the present invention, in which three lines of ground-standing independent piles 5003-1, 5003-2 and 5003-3 are shown. A plurality of bars 500A are connected to piles 5003-1 on the original inclined plane 5000 along the slope 5004. Note that the bars 500A are only connected to the first line of piles 5003-1 but not connected to the second line of piles 5003-2 at their opposite end. Although connecting bars 500A are only connected to first line piles 5003-1, i.e. are extended from the foot portion of piles 5003-1, this arrangement makes the first line piles 5003-1 slide downardly but not incline.

Figure 6:
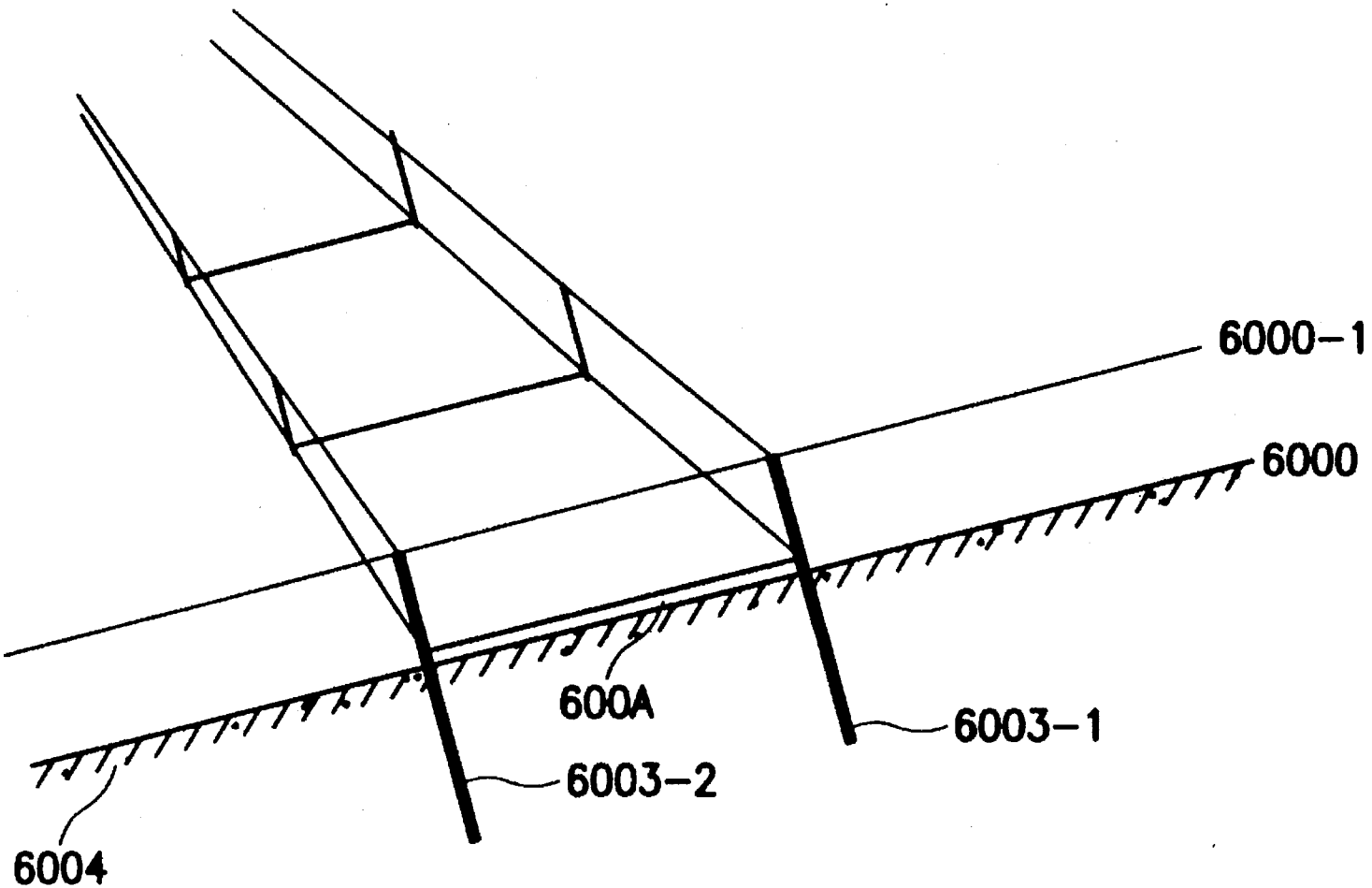
FIG. 6 is a schematic diagram showing a second and typical embodiment of the invention, in which two lines of ground-standing independent piles 6003-1 and 6003-2 are used.

Referring to FIG. 6, there is shown a second embodiment of the invention, which is a typical embodiment of the invention, in which two lines of ground-standing independent piles 6003-1 and 6003-2 are used. A plurality of connecting bars 600A are mounted on the surface of original inclined plane 6000 along the slope 6004 for connecting first line piles 6003-1 and second line piles 6003-2.

Figure 7:
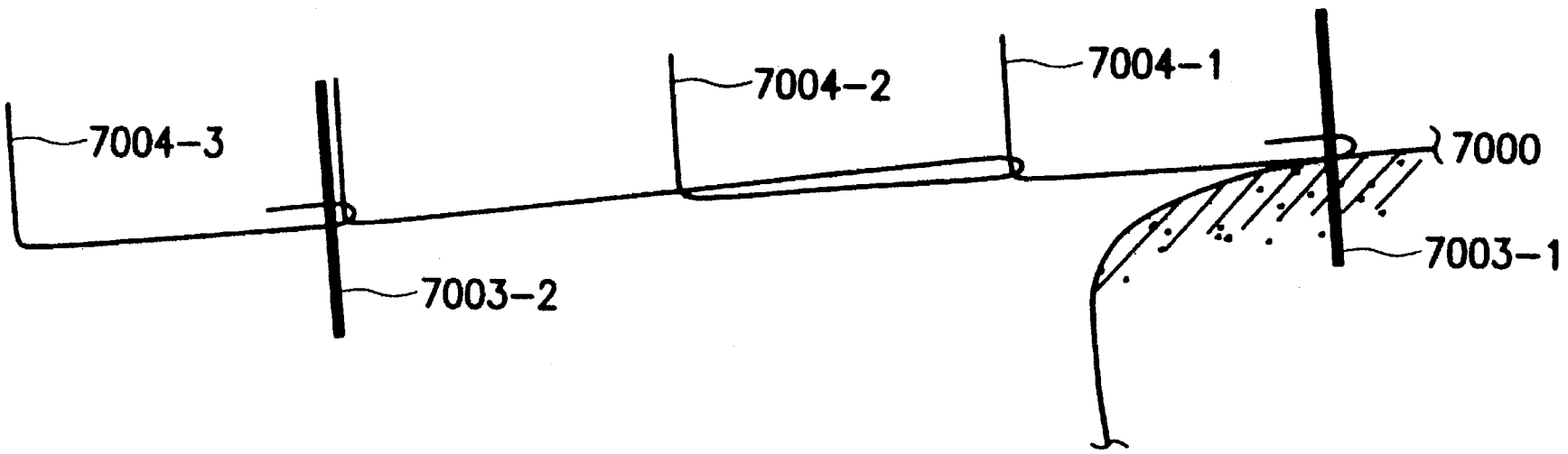
FIG. 7 is a schematic diagram showing a third embodiment of the invention in which suspension piles 7004-1, 7004-2 and 7004-3 and ground-standing piles 7003-1 and 7003-2 are used.

Referring now to FIG. 7, there is shown a third embodiment of the invention in which suspension piles 7004-1, 7004-2 and 7004-3 and ground-standing piles 7003-1 and 7003-2 are used. Note that suspension piles 7004-1, 7004-2 and 7004-3 are L-shaped with their ends being curved to form a hook. As shown in FIG. 7, suspension pile 7004-1 is hooked on ground-standing pile 7003-1, suspension pile 7004-2 is hooked on suspension 7004-1 and connected to ground-standing pile 7003-2, at its opposite end, and suspension pile 7004-3 is hooked on ground-standing pile 7003-2 so that an integral pile assembly of the invention is formed. Note in this embodiment, the suspension piles 7004-1, 7004-2 and 7004-3 also have the functions of connecting bars as in the first and second embodiments. The pile assembly of this embodiment, when subjected to the component gravity force of the soil dressing along the slope, will not be inclined but will only slide downardly. This kind of pile assembly also provides the suspension piles with a ground-standing effect.

Figure 8B:
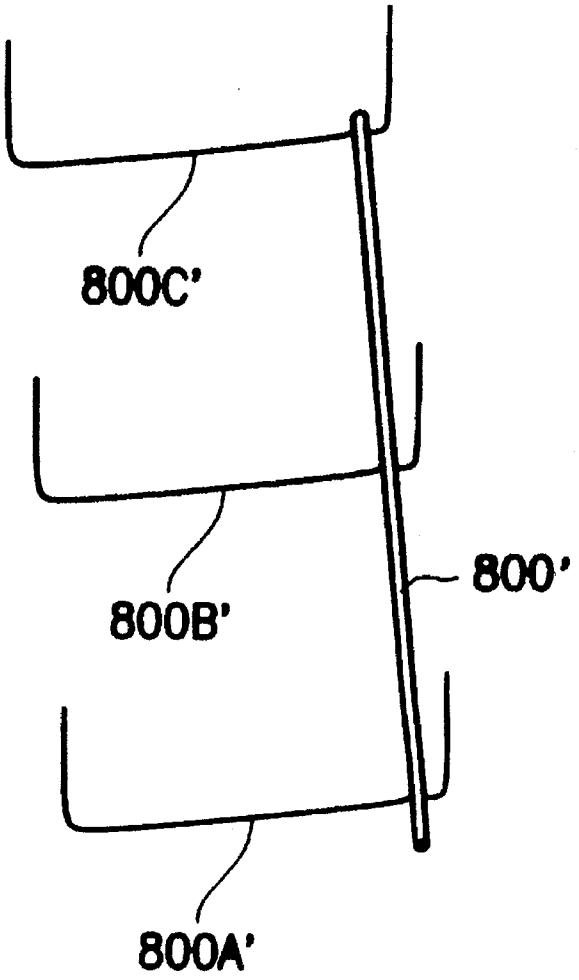
FIG. 8A and FIG. 8B are schematic diagrams showing embodiments of interlocking the connecting bars, used for connecting the ground-standing piles of the invention.
Figure 8A:
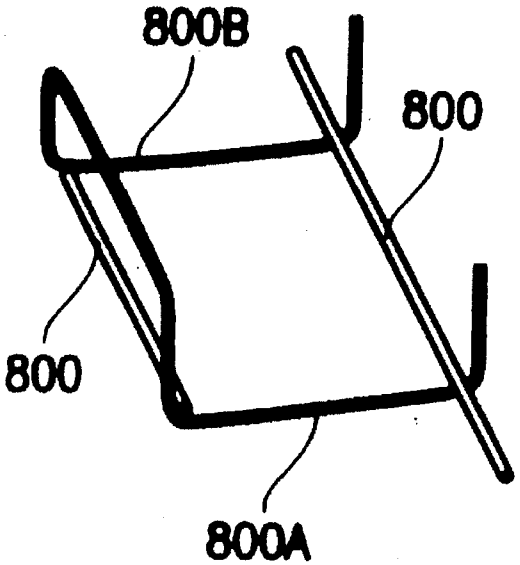

Referring to FIG. 8A and FIG. 8B, there are shown embodiments of interlocking the connecting bars, used for connecting the ground-standing piles of the invention. In FIG. 8A, U-shaped connecting bars 800A, 800B are interlocked together by welding locking bar 800 on their two bent portions. In FIG. 8B, three U-shaped connecting bars 800A', 800B' and 800C' are interlocked together by welding to a locking bar 800' on their bent portions.

Figure 9:
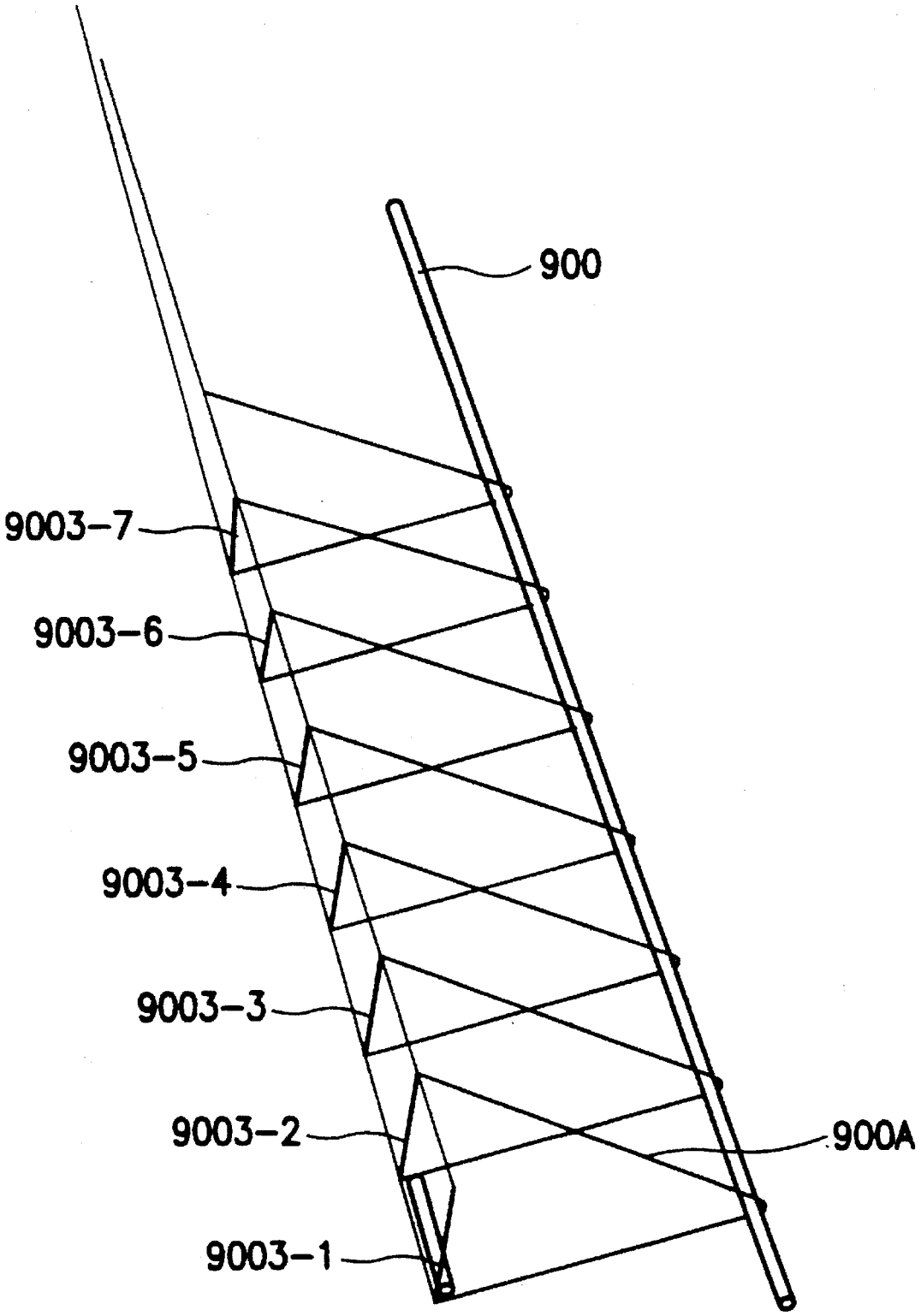
FIG. 9 is a a schematic diagram showing a perspective view of an arrangement of suspension piles, connecting bar and interlocking bar.

Referring now to FIG. 9, there is shown a perspective view of an arrangement of suspension piles, connecting bar and interlocking bar. As shown in FIG. 9, a plurality of suspension piles 9003-1, 9003-2, 9003-3, 9003-4, 9003-5, 9003-6, 9003-7 are connected by chain connecting means 900A which is made of thin metal wire and has a triangular-shaped section. An interlocking bar 900 is placed in the triangular-shaped connecting means 900A. This arrangement is particularly suitable for steep slopes. Note that by adjusting the spaced distance of suspension piles, the density of the piles to be used can be adjusted, and this constitutes an advantage of this arrangement.

Figure 10:
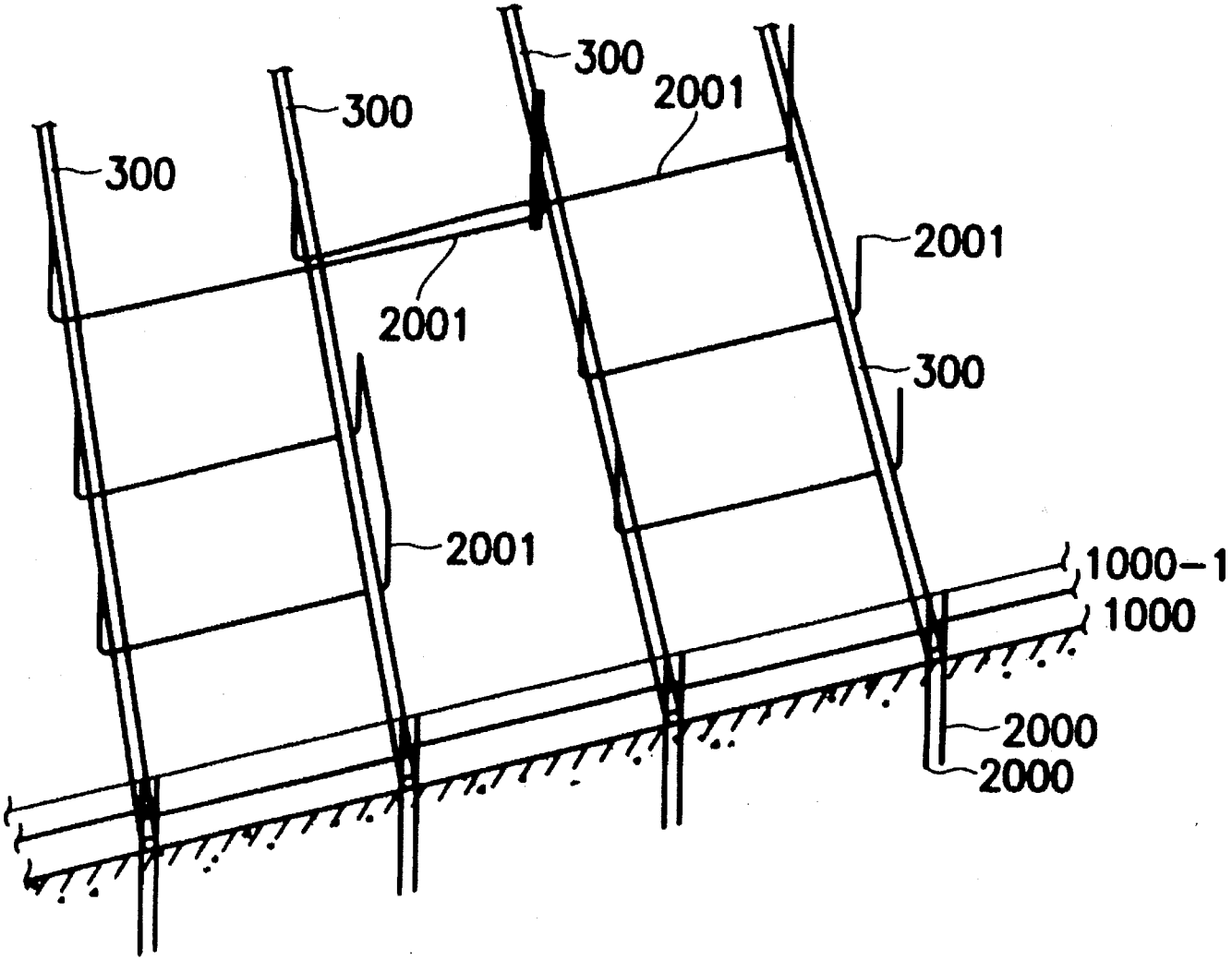
FIG. 10 is a schematic diagram showing how to assemble the pile assembly of the invention.

Finally referring to FIG. 10, there is shown a schematic diagram to explain how to assemble the pile assembly of the invention. A plurality of pairs of ground-standing piles 2000, 2000, are first driven into original inclined plane 1000 along the slope (4 pairs of ground-standing piles are shown) and then a plurality of interlocking bars 300 are disposed parallely between each pairs of ground-standing piles in a tranverse direction to the original inclined plane 1000. Thereafter, a plurality of U-shaped suspension piles 2001, which work as connecting bars, are disposed in a form as indicated in FIG. 10. To obtain a firm connecting effect, the U-shaped suspension piles 2001 can be further connected, for example by welding to the interlocking bar 300 at appropriate points. Soil holding means, for example soil holding fences, then can be mounted on the ground-standing piles 2000 and U-shaped suspension piles 2001 thus arranged.

According to the present invention, by using connecting bars between piles, the inclination of the piles, ground-standing piles and suspension piles can be avoided. Also, according to the invention, in the tranverse direction of the slope an interlocking bars are used to interlocking the piles so that a high strength pile assembly can be formed. Furthermore, according to the present invention, the disposition of ground-standing or suspension piles are more flexible. For example, in an area where soil is hard to drive into a ground-standing pile, suspension piles can instead be used. By combining the use of connecting bars, interlocking bars, suspension piles, a reliable pile assembly for fixing soil holding means can be obtained.

What is claimed is:

1. A pile assembly for fixing soil holding means used for holding soil dressing on a slope having an original inclined plane, comprising:

a plurality of rows of ground-standing piles disposed on said original inclined plane along the slope, at least one connecting bar for connecting any two of said ground-standing piles disposed on the same row;

a plurality of U-shaped suspension piles disposed at predetermined locations on said original inclined plane of said slope;

a plurality of L-shaped suspension piles disposed at predetermined locations of said original inclined plane, of said slope each of said L-shaped suspension piles has one hook end for connecting to one of said ground-standing piles or other L-shaped suspension piles; and a plurality of interlocking bars for interlocking said plurality of rows of ground standing piles and said plurality of U-shaped suspension piles in a transverse direction to said row on said original inclined plane.

2. The pile assembly of claim 1, wherein the ground-standing piles have a predetermined length and wherein the ground-standing piles are driven into the slope to a depth that is at least equal to one-half the length of the ground-standing piles.

3. The pile assembly of claim 2, wherein the ground-standing piles are driven to a depth that is at least two-thirds the length of the ground-standing piles.

4. A pile assembly for fixing soil holding means used for holding soil dressing on a slope having an original inclined plane, comprising:

a plurality of rows of ground-standing piles driven into the slope and disposed on said original inclined plane along the slope, at least one connecting bar for connecting any two of said ground-standing piles disposed on the same row;

a plurality of U-shaped suspension piles disposed at predetermined locations of said original inclined plane of said slope;

a plurality of L-shaped suspension piles disposed at predetermined locations of said original inclined plane, of said slope each of said L-shaped suspension piles has one hook end for connecting to one of said ground-standing piles or other L-shaped suspension piles; and a plurality of interlocking bars for interlocking said ground-standing piles and said U-shaped suspension piles in a traverse direction to said row on said original inclined plane.

5. The pile assembly of claim 4, wherein the ground-standing piles have a predetermined length and wherein the ground-standing piles are driven to a depth that is at least equal to one-half the length of the ground-standing piles.

6. The pile assembly of claim 5, wherein the ground-standing piles are driven to a depth that is at least two-thirds the length of the ground-standing piles.

* * * * *